US005529187A

United States Patent [19]

DeNola

[11] Patent Number: 5,529,187

[45] Date of Patent: Jun. 25, 1996

[54] MULTI-CIRCUIT BOARD CARTON AND BLANK

[75] Inventor: Robert C. DeNola, San Jose, Calif.

[73] Assignee: The Mead Corporation, Dayton, Ohio

[21] Appl. No.: 353,055

[22] Filed: Dec. 9, 1994

[51] Int. Cl.[6] ..... B65D 85/86

[52] U.S. Cl. ..... 206/449; 206/485; 206/590; 206/707; 206/723

[58] Field of Search ..... 206/45.14, 45.19, 206/485, 587, 706–709, 723, 449, 453, 590

[56] References Cited

U.S. PATENT DOCUMENTS

| | | | |
|---|---|---|---|
| 2,620,962 | 12/1952 | Powell | 206/45.19 |
| 3,314,530 | 4/1967 | Michalka | 206/45.14 |
| 3,405,860 | 10/1968 | Manizza | 229/34 |
| 3,927,761 | 12/1975 | Boyle | 206/485 |
| 4,025,039 | 5/1977 | Croll et al. | 206/485 |
| 4,450,965 | 5/1984 | Paillet | 206/528 |
| 4,461,384 | 7/1984 | Erlam | 206/485 |
| 4,485,922 | 12/1984 | Desmond et al. | 206/485 |
| 4,520,925 | 6/1985 | Johnson | 206/334 |
| 4,832,199 | 5/1989 | Rigby | 206/485 |
| 4,951,813 | 8/1990 | Sauter | 206/45.19 |
| 5,121,838 | 6/1992 | Dickie | 206/334 |
| 5,242,107 | 9/1993 | DeNola | 229/120.26 |

FOREIGN PATENT DOCUMENTS

| | | | |
|---|---|---|---|
| 1017919 | 10/1952 | France | 206/485 |
| 1377352 | 9/1964 | France . | |

*Primary Examiner*—Jimmy G. Foster
*Attorney, Agent, or Firm*—Thompson Hine & Flory

[57] ABSTRACT

The invention is a carton for packaging card-like articles. The carton includes a pair of inclined panels folded inwardly from the top of a pair of side walls. The inclined panels have a plurality of parallel slots therein for receiving the contents and keeping them in an upright spaced relationship. The lid of the carton includes an abutment flap which extends from the lid and is folded inwardly to abut the card-like contents to hold them in a position spaced from the lid. The invention also includes a blank for making such a carton.

18 Claims, 4 Drawing Sheets

MULTI-CIRCUIT BOARD CARTON AND BLANK

BACKGROUND OF THE INVENTION

The present invention relates to a carton for packaging fragile objects and, more particularly, for packaging card-like members such as printed circuit boards, CDROMs and similar high technology cards and boards. These high-technology cards and boards are especially fragile due to their minute connections and precise wirings. Therefore, in packaging them, consideration must be given for adequate cushioning from droppage and vibrations.

In many cases the packaging used for such fragile card-like articles consist of cartons having partitions, foam or other plastic cushioning means and an outer packaging. This combination of materials causes many disadvantages. The multiplicity of pieces require a labor intensive assembly, which is also material intensive and expensive. In addition, there is no environmentally satisfactory way to dispose of the foams or plastics.

U.S. Pat. No. 5,121,838 to Dickie discloses a carton for printed circuit boards and the like which may be formed from a single piece of a corrugated cardboard. The blank of Dickie, when assembled, forms an outer shell with a foldably attached inner supporting structure which includes sloping panels to space the articles from the side panels of the carton and support the articles in an upright, spaced and parallel relationship. These panels fold inwardly from the front of the carton. A top retainer is provided which is inwardly, foldably attached to one of the sloping panels as part of the inner supporting structure. This top retainer is held in place by compression tabs to maintain a space between the lid and articles.

SUMMARY OF THE INVENTION

The present invention provides a package which is inexpensive, environmentally compatible, is formed form a blank consisting of a single piece of board which can be flattened for shipment, requires minimal labor and no glue, adhesive tape or staples to assemble, and provides easy disposal for the end user. Additionally, boards or card-like members shipped in the carton are spaced on all sides from the top, bottom and side walls of the carton such that they are effectively suspended within the carton and thereby isolated from and cushioned against droppage, vibration and damage. These properties make the carton ideally suited for shipping safely expensive high tech components such as multiple printed circuit boards. (While the discussion which follows will frequently refer to the contents of the carton as printed circuit boards, those skilled in the art will appreciate that the invention is equally useful in shipping other articles and especially cards, boards, and other generally planar card-like objects.

One manifestation of the present invention is a carton comprising a bottom panel, a pair of side panels, a front panel, a back panel, and a lid. The carton includes a pair of inwardly folded inclined side panels each having at least one and preferably a plurality of parallel slots for receiving the edges of the card-like contents. The slots are located in the inclined panels so that the boards are spaced from the side and bottom panels of the carton. In addition, the slots preferably include cushioning tabs. Lap panels extend from the feet of the inclined panels and fix the position of the inclined panels relative to one another on the bottom panel.

The inclined panels preferably include a pair of triangular flaps which support the inclined side panels against the side and bottom wall of the carton. The lid includes an abutment panel which extends into the carton and lies across the top edge of the boards thereby insuring that they are spaced from the lid and isolated from damage when the cartons are stacked on top of one another.

In accordance with a further embodiment of the present invention, a blank for the aforementioned carton is provided comprising a rectangular bottom panel having a front, a back and two sides, a pair of rectangular side panels extend laterally from the two sides of the bottom panel and rectangular front wall and back wall panels extend respectively from the front and back of the bottom panel, the front, back and side panels being inwardly foldable about fold lines to a position in which they are generally perpendicular to the bottom panel. The blank further includes a pair of rectangular, slotted panels (which are inclined panels in the assembled carton) which extend laterally from each side panel, the slotted side panels are inwardly foldable about a fold line to an inclined position within the carton, lap panels extend from each slotted panel, the lap panels are outwardly foldable about a fold line between the lap panels and the slotted side panels, the lap panels overlap one another when the slotted side panels are inwardly folded to an inclined position and fix the folded position of the slotted panels with respect to one another; a rectangular lid panel extends from the back panel via a fold line, the top panel includes an abutment flap which extends from one side of the lid panel via a fold line and a pair of assembly flaps extend laterally from each of the front wall and back wall panels via a fold line and are separated from the side panels by cut lines, the assembly flaps being inwardly foldable to a position in which they are generally perpendicular to the front wall and back wall panels and lie behind the slotted panels such that they overlap the side panels when the carton is assembled.

DESCRIPTION OF THE PREFERRED EMBODIMENT

Figure 1:
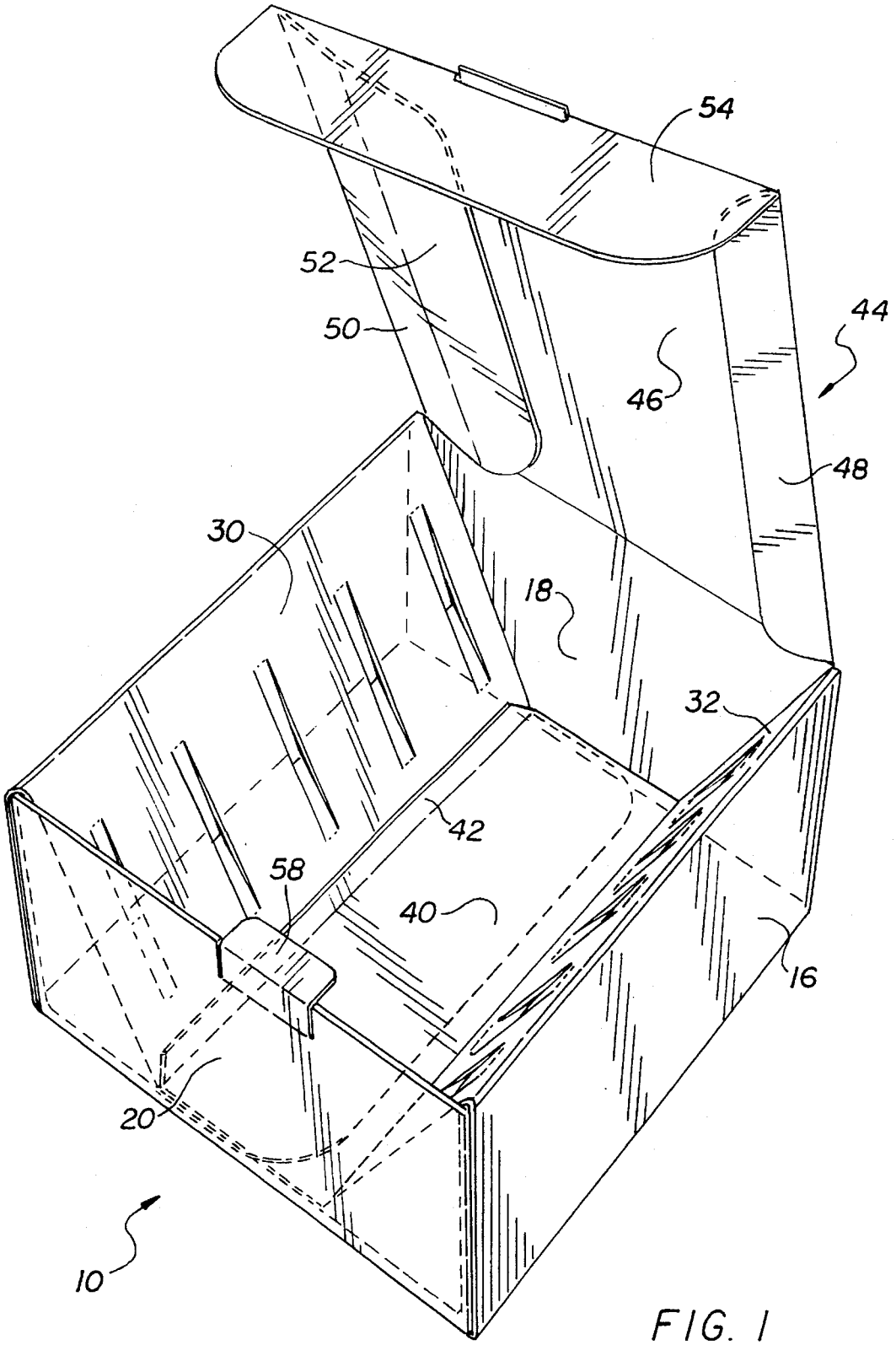
FIG. 1 is a perspective view of the assembled carton in accordance with the invention with the lid open.
Figure 2A:
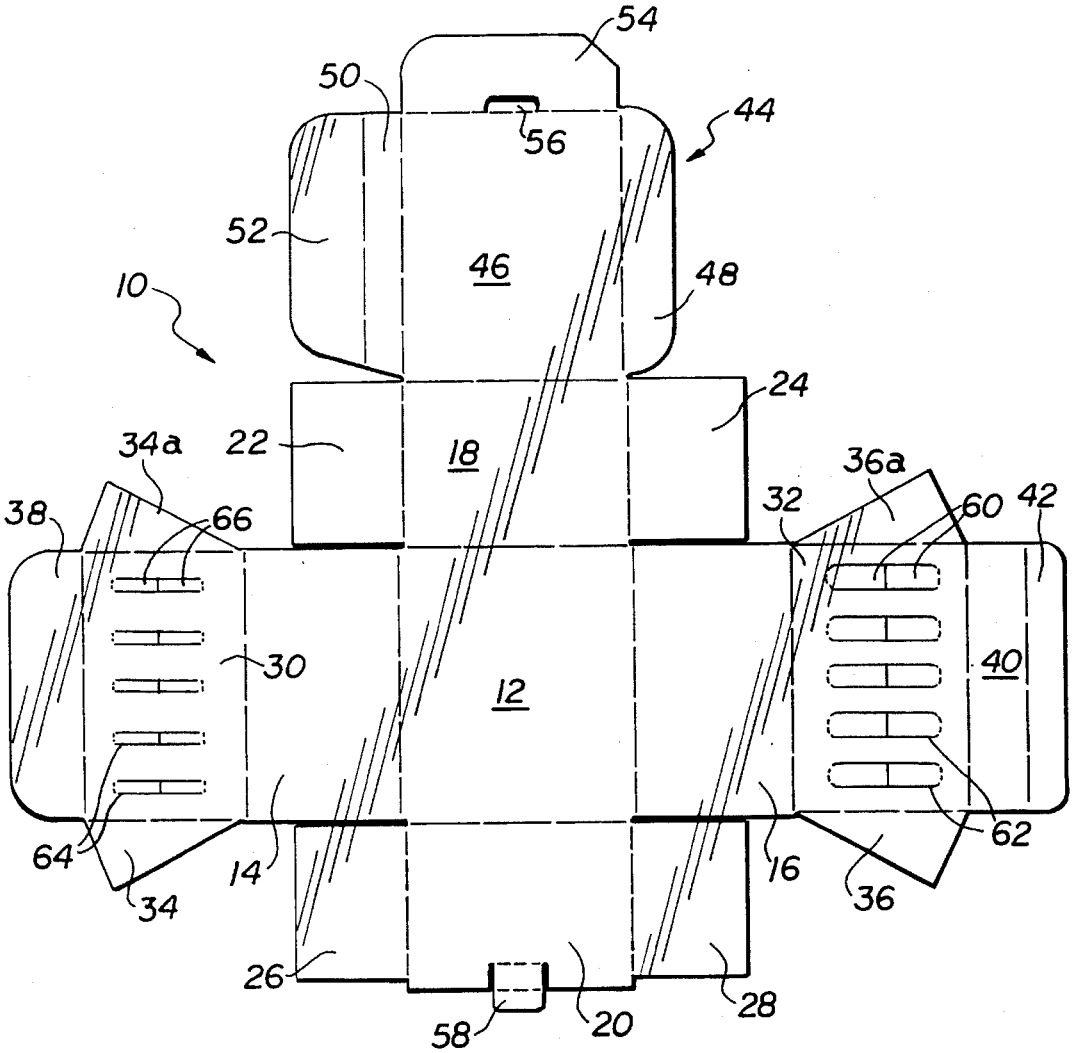
FIGS. 2(*a*)–2(*b*) are plan views of the carton blank of the present invention. For ease of illustration, FIG. 2(*a*) identifies the panels and FIG. 2(*b*) identifies the fold and cut lines.
Figure 2B:
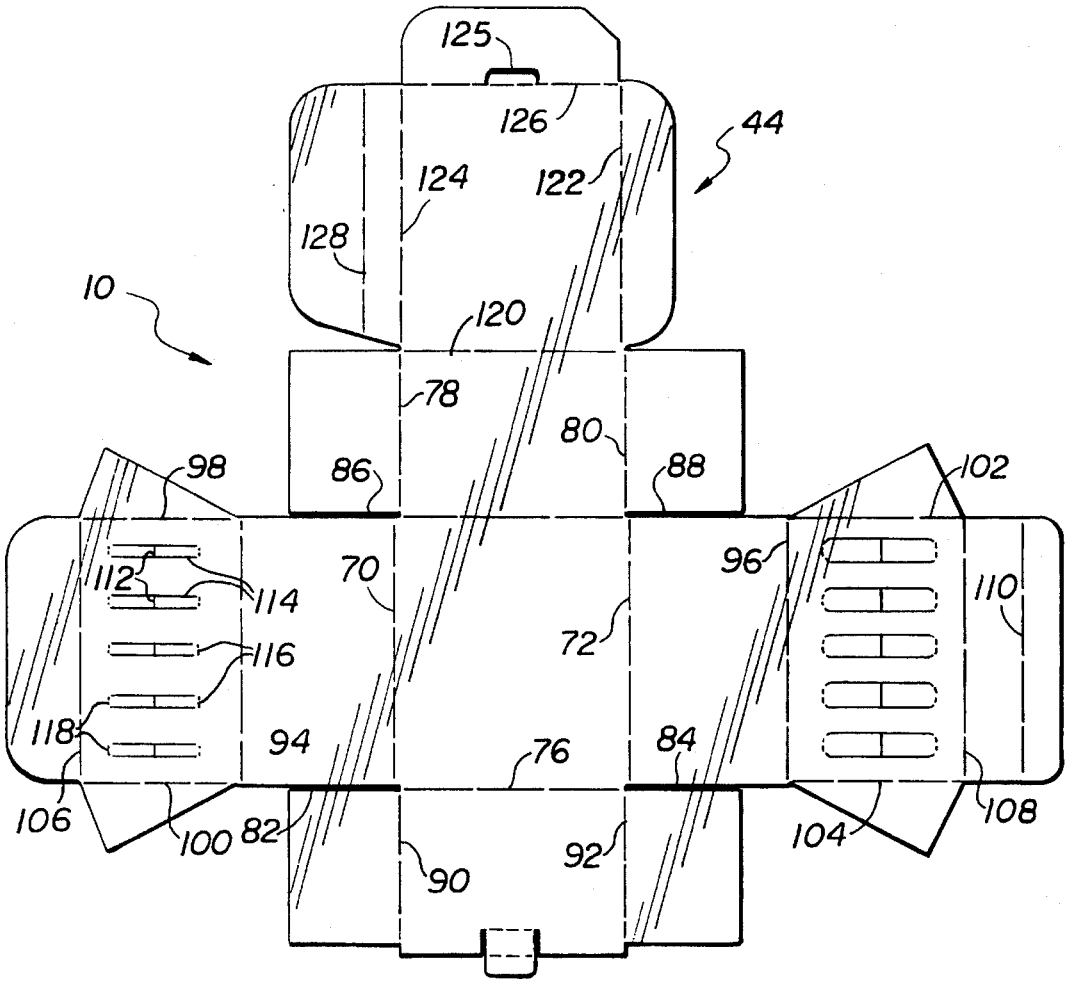

FIG. 1 shows a perspective view of the assembled carton 10 of the present invention. The carton blank 10 includes a bottom panel 12, a left side panel 14 and a right side panel 16, a front panel 20, a back panel 18 and a lid 44. Panels 14, 16, 18 and 20 extend from bottom panel 12 along a first set of fold lines 70, 72, 74 and 76 respectively, to permit inward folding. Back panel 18 and front panel 20 each includes a pair of assembly flaps 22, 24 and 26, 28, respectively, which are folded along fold lines 78, 80, 90 and 92 respectively. In the blank, the assembly flaps are cut from the side panels 14, 16 by cut lines 82, 84, 86 and 88. When assembled, assembly flaps 22, 26 are inserted inside and against side panel 14 while assembly flaps 24, 28 are inserted inside and against side panel 16 by folding inward.

The front, back, side, top and bottom panels form an "outer shell" which protects the contents of the carton. Positioned within and joined to this outer shell is an inner supporting structure which holds the planar contents in a position in which they are suspended from the outer shell. This support structure includes a pair of slotted inclined panels 30, 32 which are foldably joined and extend from the upper edges of the side panels 14, 16 along a set of fold lines 94, 96. In the assembled position, the inclined panels slope downwardly and inwardly from the side panels to the bottom panel 12 as seen in FIG. 1.

Extending from the lower end or foot of the inclined panels 30, 32 are a pair of lap panels 38, 40 foldably joined by fold lines 106, 108 respectively. When assembled, these lap panels 38, 40 extend between the lower edges 106, 108 of the inclined panels and overlap one another, lap panel 40 lying over panel 38 on the bottom panel 12. See FIG. 3. Lap panel 40 has an additional folded flap 42 extending from lap panel 40 by fold line 110. This additional flap 42 abuts the inclined panel 30 to provide a more secure fit on the bottom of the carton when assembled.

Figure 3:
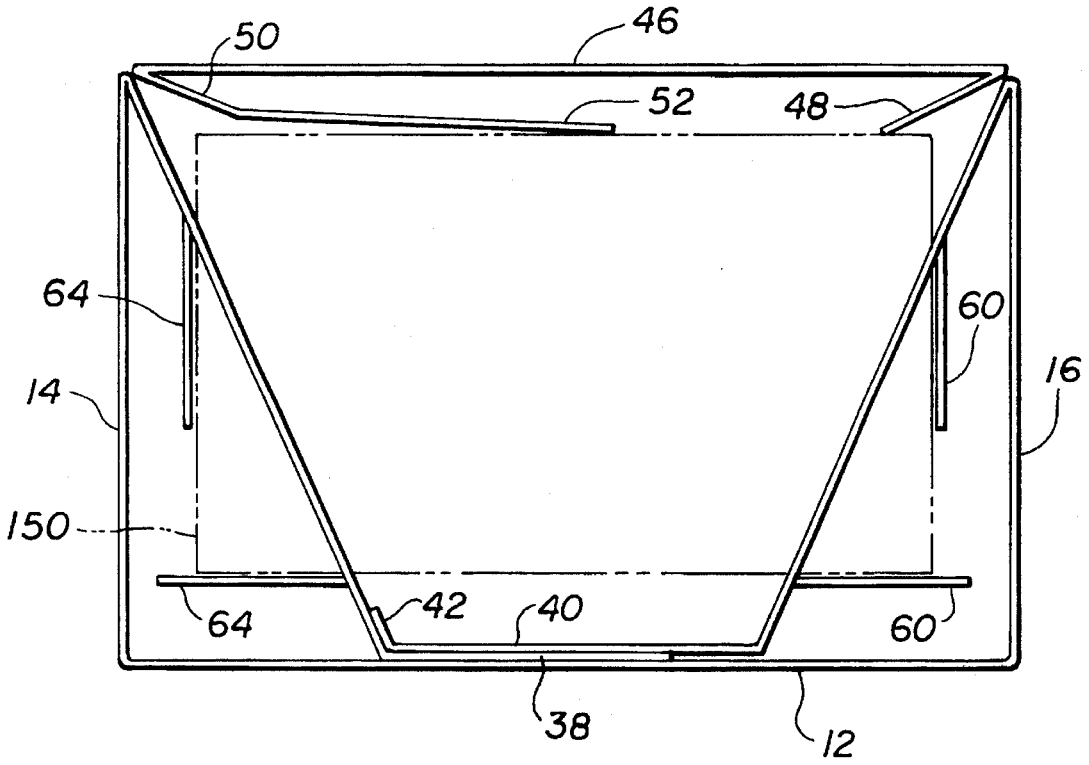
FIG. 3 is a cross-section through the carton showing a circuit board suspended therein.

Two pairs of optional but preferred triangular support flaps 34, 34*a*, 36, 36*a* extend from each inclined panel 30, 32 along fold lines 98, 100, 102, 104 respectively which permit inward folding of the triangular flaps. Each triangular flap is dimensioned to abut the side panels 14, 16 and bottom panel 12 and thereby support the inclined panels at a predetermined angle when the carton is assembled. These triangular flaps 34, 36 assist in holding the inclined panels 30, 32 in position and suspend the contents of the carton as shown in FIG. 3.

The inclined panels are provided with a plurality of parallel slots 62, 64 for receiving planar or card-like articles. Each slot extends from inside the upper to inside the lower edge of the respective inclined panel to receive a lower corner portion of a board. Thus, each slot terminates at points spaced from the upper and lower edges of the inclined panels. In this manner, the corners and edges of the boards held in these slots are spaced from the sides and the bottom panels of the container, as shown in FIG. 3. The spacing between adjacent slots and between the slots and the adjacent walls of the carton maintains article separation and separation between the articles and the walls as shown in FIG. 3.

Slots 62, 64 include a pair of cushioning tabs 60, 66 struck from the inclined panels 30, 32 using two parallel cut lines 114 and a transverse cut line 112 so that they are hinged to the respective inclined panels by fold lines 116, 118. In this manner, the cushioning tabs, 60, 66 are foldably joined to the upper and lower end edges of each slot, respectively, meeting in the middle. When boards are inserted into the slots, the tabs are folded inwardly toward the adjacent side wall 14, 16 and function as an added cushion as well as a second spacer.

The lid 44 includes a top panel 46 having a closure flap 54 which can be folded inward on fold line 126 to be inserted against the inner side of front panel 20 to close the carton. Tongue tab 58 can then be inserted into slot 56 for locking. The slot 56 is formed by cut line 125 and opens upon the folding of flap 54 inward. The lid 44 also includes side flap 48, and abutment flap 50. The flap 50 includes a panel 52 which is folded inwardly along fold line 128 when the lid is closed. The abutment flap functions to hold the contents of the carton away from the top panel 46 thereby further cushioning them from shock especially during stacking. When the lid is closed, abutment flap 50 is positioned in the carton and is long enough that it is disposed across the top edges of the contents of the carton 150 and maintains a space between the top panel 46 and the contents of the carton when the lid 44 is in the closed position as in shown in FIG. 3. Typically panel 52 is about two-thirds the width of the carton.

Using the carton of the present invention, circuit boards may be retained in the carton by inserting them in the slots 62, 64 of the inclined panels 30, 32. The angle of the incline, along with the depth and width of the slots are configured to hold and thereby suspend the circuit boards inserted in the slots a distance away from the bottom and side panels. The abutment flap 52 on the lid 44 further retains the circuit boards a distance away from the top panel 46. In this manner, the boards are suspended within the carton and isolated from external shock.

To assemble the carton from the blank, assembly flaps 26, 28 are folded inward along fold lines 90, 92 until perpendicular to front panel 20 and assembly flaps 22, 24 are folded inwardly along fold lines 78, 80 until perpendicular to back panel 18, the two side panels 14, 16 the front panel 20 and the back panel 18 are folded inward along fold lines 70, 72, 76 and 74 until they are perpendicular to the bottom panel 12. Assembly flaps 22, 26 are positioned so that they overlap side panel 14, while assembly flaps 24, 28 are positioned so that they overlap side panel 16.

Slotted side panel 30 is then folded inward by rotation around fold line 94 until it achieves an inclined position from fold line 94 to the bottom panel 12 within the box. Lap panel 38 is folded outwardly from the slotted side panel 30 so that it rests flat on the bottom panel 12. The slotted side panel 32 is then folded inward by rotation about fold line 96 until it achieves an inclined position from fold line 96 to the bottom panel 12 within the box. The lap panel 40 is folded outwardly from fold line 108 so that it rests flat on the lap panel 38. Additional folded flap 42 is folded outwardly from the lap panel 40 by fold line 110. It then rests flat on the inclined, slotted side panel 30 to provide a secure fit on the bottom panel.

Optionally, but preferably, the blank further includes two pairs of triangular support flaps 34, 34*a*, and 36, 36*a* which are folded inwardly along fold lines 98, 100, 102, 104 until they are perpendicular with their respective slotted side panels. When the slotted inclined panels 30, 32 are folded, the triangular flaps 34, 34*a* abut side panel 14 and bottom panel 12 to support the slotted inclined panel at a predetermined angle. Similarly, triangular flaps 36, 36*a* abut side panel 16 and bottom panel 12 when slotted panel 32 is folded inward.

When the lid is closed, closure flap 54 is folded inwardly along fold line 126 until it is perpendicular with top panel 46. Upon folding, slot 56 opens providing a space for receiving tongue tab 58. Side flaps 48, 50 are folded inward along fold lines 122 and 124 respectively and the abutment flap 52 is folded inward from side flap 50 along fold line 128. This flap not only holds the contents apart from the lid, but adds additional protection for the articles against droppage or vibrations. Top panel 46 is folded inwardly along fold line 120 until it is approximately perpendicular to back panel 18. In this position closure flap 54 lies flat inside and against front panel 20. Side flap 48 lies flat inside and against inclined slotted side panel 32. Side flap 50 lies inside and against inclined slotted side panel 30 and abutment flap 52 lies against the contents. Finally, tongue tab 58 is inserted into slot 56 completing the assembly.

The carton of the present invention is advantageous because it is made from a single piece of material, preferably paperboard or corrugated board. Before assembly, the blank has a flat configuration which is easy to ship. By simple folding, the user can easily assemble the carton without the need of additional materials. For example, no glue, staples, adhesive tape or packing is needed. Because of this lack of additional materials, the cost is minimized. In addition, when the user is finished with the carton, since the paperboard or corrugated board is recyclable, it may be easily disposed of in an environmentally acceptable manner.

Having described the invention in detail and by reference to preferred embodiments thereof, it will be apparent that modifications and variations are possible without departing from the scope of the invention defined in the appended claims.

What is claimed is:

1. A carton for packaging card-like articles comprising:

a bottom panel, a pair of side panels, a front panel, a back panel, a lid, and a pair of inclined panels having a plurality of slots therein for receiving contents, said slots running parallel to one another, each of said inclined panels extending from the top of each of said side panels and being folded inwardly to an inclined position within said carton, said lid including an abutment flap which extends from one side of said lid, said abutment flap being folded inwardly when said lid is closed so that it abuts said card-like articles and thereby holds said articles in a position spaced from said lid;

wherein said abutment flap includes a fold line which divides said abutment flap into first and second panels, said first panel extending downwardly into said carton and said second panel extending laterally and abutting said card-like articles.

2. The carton of claim 1 wherein said second panel is long enough that it is disposed across the top edges of said card-like articles and maintains a space between said lid and said articles.

3. The carton of claim 2 wherein said slots terminate at a point inside of the upper and lower edges of said inclined panels to space said card-like articles from said side and bottom panels.

4. The carton of claim 2 wherein said slots each include a pair of cushioning tabs hinged to an upper and a lower end of said slot.

5. The carton of claim 2 further comprising a lap panel extending from the foot of each of said inclined panels, said lap panels overlying said bottom panel of said carton and overlapping one another when said inclined panels are folded inwardly thereby maintaining said inclined panels at an angle which retains said card-like articles in spaced relation to said bottom and side panels.

6. The carton of claim 5 wherein said inclined panels each includes a pair of triangular flaps, said triangular flaps supporting said inclined panel at a predetermined angle of inclination with respect to said side panels and said bottom panel.

7. The carton of claim 6 wherein said inclined panels are inclined at an angle and said slots are positioned in said inclined panels such that said card-like articles are spaced from said bottom and sides of said carton.

8. The carton of claim 2 wherein said slots are rectangular.

9. The carton of claim 1 wherein said carton is formed from a blank which consists of a single sheet of material.

10. The carton of claim 9 wherein said blank is formed from corrugated board.

11. A blank for a carton comprising:

a rectangular bottom panel having a front, a back and two sides;

a pair of rectangular side panels extending from each of said sides of said bottom panel, a pair of fold lines between said side panel and said bottom panel;

a rectangular front wall panel and a rectangular back wall panel extending respectively from the front and back of said bottom panel, fold lines between said front and back walls and the bottom panel;

said front wall, back wall and side panels being inwardly foldable about said fold lines to a position in which they are generally perpendicular to said bottom panel;

a pair of rectangular, slotted panels extending laterally from each side panel and fold lines between said slotted panels and said side panels; said slotted panels being inwardly foldable about a fold line to an inclined position within said carton;

a rectangular lid panel extending from said back panel by means of a fold line, said lid panel including an abutment flap extending from one side of said lid panel by means of a fold line; and a pair of assembly flaps extending laterally from each of said front wall and back wall panels by means of fold lines and being cut from said side panels by cut lines;

said assembly flaps being inwardly foldable to a position in which they are generally perpendicular to said front wall and said back wall panels and overlap said side panels when said carton is assembled.

12. The blank of claim 11 wherein said slotted panels include a plurality of parallel running slots.

13. The blank of claim 12 wherein said abutment flap includes a fold line which divides said flap into first and second panels.

14. The blank of claim 13 wherein said slots include a pair of cushioning tabs defined by two parallel cut lines and a transverse cut line, said cushioning tabs being hinged to said slotted panels at the ends of said slots by fold lines.

15. The blank of claim 13 wherein each of said slotted panels includes a lap panel extending from the foot of said slotted panels, said lap panels being outwardly foldable and overlapping one another when said slotted side panels are inwardly folded to an inclined position.

16. The blank of claim 15 wherein each of said slotted panels includes a pair of triangular flaps, said triangular panels maintaining said slotted panels at a desired angle of inclination with respect to said bottom and side panels.

17. The blank of claim 11 wherein said blank is formed of a single sheet of material.

18. The blank of claim 17 wherein said blank consists of corrugated board.

* * * * *